United States Patent [19]

Kipp et al.

[11] Patent Number: 4,636,321

[45] Date of Patent: Jan. 13, 1987

[54] WATER SOLUBLE LUBRICANT

[75] Inventors: Egbert M. Kipp, Devon, Pa.; Thomas E. Kirk, Henrico County; Barry L. Riddle, Richmond, both of Va.

[73] Assignee: Reynolds Metals Company, Richmond, Va.

[21] Appl. No.: 822,462

[22] Filed: Jan. 27, 1986

Related U.S. Application Data

[63] Continuation-in-part of Ser. No. 782,011, Sep. 30, 1985, abandoned.

[51] Int. Cl.[4] ..... C10M 173/00

[52] U.S. Cl. ..... 252/49.3; 252/32.5

[58] Field of Search ..... 252/32.5, 49.3; 72/42

[56] References Cited

U.S. PATENT DOCUMENTS

| | | | |
|---|---|---|---|
| 2,825,693 | 3/1958 | Beaubien et al. | 252/32.5 |
| 3,152,990 | 10/1964 | Coppock et al. | 252/32.7 |
| 3,177,144 | 4/1965 | Reamer et al. | 252/32.5 |
| 3,233,442 | 2/1966 | Zvanut | 72/42 |
| 3,374,171 | 3/1968 | Davis | 252/34.7 |
| 3,527,726 | 9/1970 | Gower et al. | 260/29.6 |
| 3,645,897 | 2/1972 | Gower et al. | 252/34.7 |
| 3,676,345 | 7/1972 | Kuceski | 252/49.3 |
| 3,945,930 | 3/1976 | Sugiyama et al. | 252/32.5 |
| 3,966,619 | 6/1976 | Smith et al. | 252/32.5 |
| 3,980,571 | 9/1976 | Marx | 252/32.5 |
| 4,033,886 | 7/1977 | Felton, Jr. | 252/34.7 |
| 4,160,089 | 7/1979 | Bussi et al. | 544/78 |
| 4,172,800 | 10/1979 | Walker | 252/8.5 C |
| 4,243,537 | 1/1981 | Knepp et al. | 252/49.3 |
| 4,268,404 | 5/1981 | Ahlgrim et al. | 252/25 |
| 4,402,839 | 9/1983 | Davis et al. | 252/34.7 |
| 4,452,711 | 6/1984 | Laemmle | 252/49.3 |
| 4,452,712 | 6/1984 | Laemmle | 252/49.3 |
| 4,493,780 | 1/1985 | Schwartz et al. | 252/73 |

*Primary Examiner*—William R. Dixon, Jr.
*Attorney, Agent, or Firm*—Alan T. McDonald

[57] ABSTRACT

An improved water soluble metal working lubricant concentrate is disclosed. The lubricant concentrate consists essentially of a polyalkylene glycol polymer, an ethoxylated carboxylic acid or alcohol, a complex organic phosphate ester, an alkanolamine and water.

12 Claims, No Drawings

WATER SOLUBLE LUBRICANT

CROSS-REFERENCE TO RELATED APPLICATIONS

This is a continuation-in-part of U.S. application Ser. No. 782,011, filed Sept. 30, 1985, now abandoned.

FIELD OF THE INVENTION

The present invention relates to water soluble metal working lubricants and more specifically to lubricants useful in working aluminum.

BACKGROUND OF THE INVENTION

The prior art is replete with lubricant formulations useful in the rolling of metals such as aluminum.

With the evolution of rolling equipment toward rolling mills that produce higher pressures at ever-increasing operating speeds, the demands placed on the lubricants used in such mills have increased with each new generation of rolling equipment. Such increasing demands have resulted in further expansion of the list of lubricant formulations useful in rolling operations.

To the best of our knowledge, however, there are certain attributes which a metal working lubricant must possess to be a suitable material for cold working of metal, such as cold rolling of metal foil or sheet or foil-plastics film laminates, stamping, drawing and ironing. These attributes include the ability to (1) withstand the high shear forces encountered during metal working, (2) provide a highly specular surface, (3) exhibit extreme pressure lubricating properties, (4) operate as a single phase lubricant, (5) provide good heat transfer, (6) provide a clean, streak-free surface upon subsequent heat treatment, and (7) prevent transfer of metal oxides from the workpiece to the tool.

Each of these characteristics is familiar to the skilled lubricant technician. Most of the abovestated attributes are self-explanatory. Some of these, however, need further explanation.

The ability to provide adequate extreme pressure lubrication defines the ability of the lubricant to reduce or prevent conditions of seizure or welding between the tool, e.g., the rolling mill, etc., and the work piece under conditions of extreme load.

The ability to operate as a single phase lubricant provides uniform fluid film in the tool-workpiece interface. It also permits the lubricant to undergo reclamation processes, such as filtration, centrifugation, etc.

The term single phase lubricant refers to a lubricant in which the components of the lubricant are soluble at room temperature. This is in contrast to macroemulsion lubricants, sometimes incorrectly referred to as "soluble oil" lubricants, and microemulsion lubricants, which have dispersed phase droplets predominately less than 0.2 micrometers in diameter.

Thus, it has been the aim of the formulators of lubricants to design a formulation which provides all of the foregoing properties.

However, those known lubricants which exhibit all of the desired properties have problems of their own. These problems include (1) fire hazard, (2) toxicity hazard, (3) unacceptable air emissions, (4) cost, and (5) poor productivity. These problems result from the fact that these lubricants are petroleum based. There remains, therefore, a need for metal working lubricants which provide all of the desired properties previously described and which eliminate or reduce substantially the problems associated with the known lubricant systems.

SUMMARY OF THE INVENTION

There has now been discovered a water soluble concentrate which provides a water soluble lubricant which eliminates substantially all of the foregoing problems with such lubricants and demonstrates substantially improved lubricant characteristics.

According to the present invention, there is provided a water soluble metal working lubricant concentrate consisting essentially of:

(a) From about 10 to about 60 percent by weight of a polyalkylene glycol polymer having the formula $$R_1O[CH_2\overset{\overset{\displaystyle CH_3}{|}}{C}HO]_a[CH_2CH_2O]_bH$$

wherein $R_1$ is selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkyaryl hydrocarbons having from about 7 to about 30 carbon atoms;

and wherein a may range between about 0 and about 75, b may range between about 1 and about 100 and b is greater than or equal to a;

(b) from about 1 to about 25 percent by weight of an ethoxylated carboxylic acid or alcohol having the formula $$R_2\overset{\overset{\displaystyle O}{\|}}{C}O[CH_2CH_2O]_cH \text{ or } R_2\underset{\underset{\displaystyle H}{|}}{\overset{\overset{\displaystyle R_3}{|}}{C}}O[CH_2CH_2O]_cH$$

wherein $R_2$ and $R_3$ are defined as is $R_1$ above, but need not be identical to $R_1$ or to each other so long as they can be described as is $R_1$;

and wherein c may range between about 1 and about 100;

(c) from about 1 to about 25 percent by weight of a complex organic phosphate ester having the formula

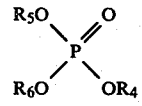

wherein $R_4$ is selected from the group consisting of hydrogen or mono-, di- or triethanolamine;

wherein $R_5$ is a polyoxyalkylated alcohol wherein the alcohol portion is derived from a member of the group consisting of saturated and unsaturated alkyl radicals having from about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_5$ is derived from ethylene oxide, propylene oxide, a polyhydroxy substituted alkanol having from about 2 to about 10 carbon atoms, or a combination of these, wherein the number of monomeric units of any single type is from about 1 to about 100;

and wherein $R_6$ is defined as is $R_4$ or as is $R_5$ above, but need not be identical to either, so long as it can be described as is one or the other;

(d) from about 1 to about 20 percent by weight of an alkanolamine, such as mono-, di- or triethanolamine; and (e) from about 0 to about 65 percent by weight water.

DETAILED DESCRIPTION OF THE PREFERRED EMBODIMENTS

The ingredients of metal working lubricants can be generally classified according to their primary functions. Such a classification scheme is valuable as an organizational tool, but it must be understood that most lubricant ingredients fulfill multiple functions. When properly chosen, the ingredients of a lubricant formulation may act cooperatively, that is, one or more components may enhance the effectiveness of one or more of the other components.

This functional or operational classification divides lubricants into three basic categories. These categories are: (1) the vehicle, (2) the solvent, and (3) lubricant additives. The final category is further subdivided into additives which provide or enhance (a) film strength, and (b) extreme pressure capability (E.P. hereafter).

In the present lubricant composition, water may be present in the lubricant concentrate to promote mutual solubility of the ingredients and to reduce the concentrate viscosity. Most generally, water concentrations, in the concentrate, of up to about 65 percent by weight are satisfactory for most applications. However, in some certain embodiments of the present invention, those physical characteristics of the concentrate which make transportation and storage more convenient may be achieved without the presence of water.

The vehicle of the present lubricant is a polyalkylene glycol polymer. The molecular structure, molecular weight, polarity, cloud point, viscosity and terminal group functionality are selected so that, in use, this vehicle thermally separates from the aqueous solution when flooded onto the metal workpiece. A hydrodynamic (full fluid) film is formed on the work surface. The film thus formed provides load support and functions as a vehicle in carrying the other ingredients into the work zone; the roll bite, in the case of rolling. Incorrect selection of this polymer ingredient's molecular features and physical properties for the metal working operation of interest will result in catastrophic failure of the lubricant through excessive workpiece-tool slippage and scuffing of the workpiece, seizure between the workpiece and the tool, galling, residue formation, corrosion, etc.

A wide variety of compatible polyalkylene glycol materials are useful as the vehicle in the formulations of the present invention. Useful such materials are available under the tradenames "Carbowax" and "Ucon" from Union Carbide Corporation of Danbury, Conn. and "Pluronic" and "Tetronic" from BASF Wyandotte of Parsippany, N.J. The concentration of the vehicle in the concentrate and in the final lubricant may, of course, vary widely depending upon such factors as the metal being worked, the speed of the working operation, the type of working operation, choice of additional ingredients, etc. For most applications, polyalkylene glycol polymer molecular weights in the range of about 200 to about 12,000 are preferred. Most generally, vehicle concentrations, in the concentrate, of between about 10 to about 60 percent by weight are satisfactory for most applications, particularly in the rolling of aluminum. The polyalkylene glycol polymer has the formula $$R_1O[CH_2\overset{\overset{\displaystyle CH_3}{|}}{C}HO]_a[CH_2CH_2O]_bH$$

wherein $R_1$ is selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkyaryl hydrocarbons having from about 7 to about 30 carbon atoms;

and wherein a may range between about 0 and about 75, b may range between about 1 and about 100 and b is greater than or equal to a.

The polyalkylene glycol polymers must be soluble in water at room temperature and may have a viscosity ranging between about 55 and about 9000 Saybolt Seconds Universal at 100 F.

Film strength improving additives are normally products such as fatty acids, fatty alcohols and fatty esters. Such materials become concentrated during rolling operations in the roll bite because of the attraction between the metal surface(s) and the polar functional groups of these molecules. In the work zone, these additives function by providing a cushion between surfaces and by acting on both the viscosity and the film strength of the vehicle. Various fatty acids, fatty alcohols and fatty esters have been used as such additives in the aluminum industry. Although such fatty materials have seen broad application in this field, their effectiveness as film strength improving additives has been diminished either because of their tendency to form insoluble metallic soaps which blind the filtration systems conventionally used to purify lubricants/coolants in operating systems or because they are inherently water insoluble, requiring the use of an emulsifying agent. Short chain materials of these classes, i.e., less than about 7 carbon atoms, which are water soluble, have been shown to be ineffective as film strength improvers.

In the lubricant compositions of the present invention, the film strength improving component is an ethoxylated carboxylic acid or alcohol. It is present, in the lubricant concentrate, in an amount from about 1 to about 25 percent by weight and has the formula $$R_2\overset{\overset{\displaystyle O}{\|}}{C}O[CH_2CH_2O]_cH \text{ or } R_2\overset{\overset{\displaystyle R_3}{|}}{\underset{\underset{\displaystyle H}{|}}{C}}O[CH_2CH_2O]_cH$$

wherein $R_2$ and $R_3$ are defined as is $R_1$ above, but need not be identical to $R_1$ or to each other so long as they can be described as is $R_1$;

and wherein c may range between about 1 and about 100.

The ethoxylated carboxylic acid or alcohol must be both soluble in water and a liquid of itself at room temperature.

Useful such materials are available from Emery Industries, Inc. of Mauldin, S.C., under the tradenames "Emsorb" and "Trydet", from ICI Americas, Inc. of Wilmington, Del. under the tradename "Myrj", from GAF Corporation of New York, N.Y. under the tradename "Emulphor", and from Alkaril Chemicals, Ltd. of Yorkshire, England under the tradename "Alkasurf".

The next component of the lubricant compositions of the present invention is the "extreme pressure" or E.P. additive. Such additives, as indicated above, concentrate in the roll bite or other area of metal working, much like the film strength improving additives do, but are generally thought to react with the metal or metal oxide rubbing surfaces to form a solid film of lubricant.

Useful organic phosphate esters are those having the forumla

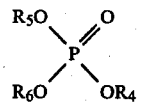

wherein $R_4$ is selected from the group consisting of hydrogen or mono-, di- or triethanolamine;

wherein $R_5$ is a polyoxyalkylated alcohol wherein the alcohol portion is derived from a member of the group consisting of saturated and unsaturated alkyl radicals having about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_5$ is derived from ethylene oxide, propylene oxide, a polyhydroxy substituted alkanol having from about 2 to about 10 carbon atoms, or a combination of these, wherein the number of monomeric units of any single type is from about 1 to about 100;

and wherein $R_6$ is defined as is $R_4$ or as is $R_5$ above, but need not be identical to either, so long as it can be described as is one or the other;

The concentration of the complex organic phosphate ester in the lubricant concentrate of the present invention may range between about 1 and about 25 percent by weight. Generally the complex phosphate ester E.P. additive should be neutralized with sufficient alkanolamine, such as mono-, di- or triethanolamine, so as to provide a pH of about 7.0 to about 9.0 in the metal working fluid. According to the present invention, the alkanolamine is present in an amount from about 1 to about 20 percent by weight of the lubricant concentrate.

Complex organic phosphate esters of the type described hereinabove are readily available under the following tradenames from these companies: "Maphos" from Mazer Chemicals, Inc. of Gurnee, Ill., "Cyclophos" from Cyclo Chemicals Corporation of Miami, Fla., "Gafac" and "Antara" from GAF Corporation of New York, N.Y., "Vanlube" from R. T. Vanderbilt Company, Inc. of Norwalk, Conn., and "Atphos" from ICI Americas of Wilmington, Del.

The complex organic phosphate esters must be soluble in water at room temperature. Simple alkyl phosphate esters are ineffective as E.P. additives in this invention because they permit metal oxide transfer from the workpiece to the tool. The complex organic phosphate esters, in addition to their E.P. properties, provide corrosion inhibition, dispersion of wear debris and water stain inhibition.

The lubricant, as used, may comprise from about 90 to about 99 percent by weight water and from about 1 to about 10 percent by weight of the lubricant concentrate.

Other minor components may be present in the lubricant concentrate. These include biocides, such as "Kathon 886MW" from Rohm and Haas, Inc. of Philadelphia, Pa. and defoamers, such as "M3032W" from American Inks and Coatings of Valley Forge, Pa. The biocide should not exceed about 0.001 percent by weight of the lubricant and the defoamer should not exceed about 0.01 percent by weight of the lubricant.

While the lubricant compositions of the present invention have been described with reference to certain specific embodiments thereof, it is not intended to be so limited thereby, except as set forth in the accompanying claims.

We claim:

1. A water soluble metal working lubricant concentrate consisting essentially of:

(a) From about 10 to about 60 percent by weight of a polyalkylene glycol polymer having the formula

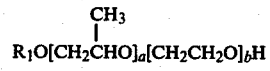

wherein $R_1$ is selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkyaryl hydrocarbons having from about 7 to about 30 carbon atoms;

and wherein a may range between about 0 and about 75, b may range between about 1 and about 100 and b is greater than or equal to a;

(b) from about 1 to about 25 percent by weight of an ethoxylated carboxylic acid or alcohol having the formula

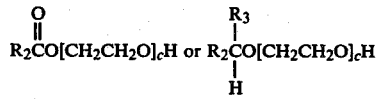

wherein $R_2$ and $R_3$ each are selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkyl aryl hydrocarbons having from about 7 to about 30 carbon atoms, but $R_2$ and $R_3$ need not be identical to $R_1$ or to each other; and wherein c may range between about 1 and about 100;

(c) from about 1 to about 25 percent by weight of a complex organic phosphate ester having the formula

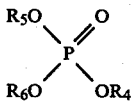

wherein $R_4$ is selected from the group consisting of hydrogen or mono-, di- or triethanolamine;

wherein $R_5$ is a polyoxyalkylated alcohol wherein the alcohol portion is derived from a member of the group consisting of saturated and unsaturated alkyl radicals having about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_5$ is derived from ethylene oxide, propylene oxide, a polyhydroxy substituted alkanol having from about 2 to about 10 carbon atoms, or a combination of these, wherein the number of monomeric units of any single type is from about 1 to about 100;

and wherein $R_6$ is defined as is $R_4$ or as is $R_5$ above, but need not be identical to either, so long as it can be described as is one or the other;

(d) from about 1 to about 20 percent by weight of an alkanolamine, such as mono-, di- or triethanolamine; and (e) from about 0 to about 65 percent by weight water.

2. The concentrate of claim 1 wherein the concentration of alkanolamine in the concentrate imparts to the metal working lubricant a pH between about 7.0 and 9.0.

3. The concentrate of claim 1 wherein the ethoxylated carboxylatic acid or alcohol of part (b) is a polyethylene glycol monoester.

4. The concentrate of claim 1 wherein the ethoxylated carboxylic acid or alcohol of part (b) is a polyethylene glycol adduct of an aliphatic alcohol.

5. The concentrate of claim 1 wherein the polyalkylene glycol of part (a) is a homopolymer of ethylene oxide.

6. The concentrate of claim 1 wherein the polyalkylene glycol of part (a) is a copolymer of ethylene oxide and propylene oxide.

7. The concentrate of claim 1 wherein the polyalkylene glycol of part (a) is a mixture of a homopolymer of ethylene oxide and a copolymer of ethylene oxide and propylene oxide.

8. The concentrate of claim 1 wherein $R_4$ is hydrogen, $R_5$ is the radical of an ethoxylated aliphatic alcohol and $R_6$ is hydrogen.

9. A water soluble metal working lubricant consisting essentially of (I) from about 90 to about 99 percent by weight water; and (II) from about 1 to about 10 percent by weight of a water soluble metal working lubricant concentrate consisting essentially of (a) from about 10 to about 60 percent by weight of a polyalkylene glycol polymer having the formula $$R_1O[CH_2\overset{\overset{\displaystyle CH_3}{|}}{C}HO]_a[CH_2CH_2O]_bH$$

wherein $R_1$ is selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkyaryl hydrocarbons having from about 7 to about 30 carbon atoms;

and wherein a may range between about 0 and about 75, b may range between about 1 and about 100 and b is greater than or equal to a;

(b) from about 1 to about 25 percent by weight of an ethoxylated carboxylic acid or alcohol having the formula $$R_2\overset{\overset{\displaystyle O}{\|}}{C}O[CH_2CH_2O]_cH \text{ or } R_2\overset{\overset{\displaystyle R_3}{|}}{\underset{\underset{\displaystyle H}{|}}{C}}O[CH_2CH_2O]_cH$$

wherein $R_2$ and $R_3$ each are selected from the group consisting of hydrogen, normal hydrocarbons having from about 2 to about 20 carbon atoms, polyhydroxy substituted hydrocarbons having from about 2 to about 10 carbon atoms, aryl hydrocarbons having from about 6 to about 20 carbon atoms and alkylaryl hydrocarbons having from about 7 to about 30 carbons atoms, but $R_2$ and $R_3$ need not be identical to $R_1$ or to each other; and wherein c may range between about 1 and about 100;

(c) from about 1 to about 25 percent by weight of a complex organic phosphate ester having the formula

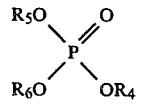

wherein $R_4$ is selected from the group consisting of hydrogen or mono-, di- or triethanolamine;

wherein $R_5$ is a polyoxyalkylated alcohol wherein the alcohol portion is derived from a member of the group consisting of saturated and unsaturated alkyl radicals having about 1 to about 20 carbon atoms, aryl radicals, and alkylaryl radicals wherein the alkyl substituent comprises from about 1 to about 20 carbon atoms and is saturated or unsaturated, and wherein the polyoxyalkylated portion of $R_5$ is derived from ethylene oxide, propylene oxide, a polyhydroxy substituted alkanol having from about 2 to about 10 carbon atoms, or a combination of these, wherein the number of monomeric units of any single type is from about 1 to about 100;

and wherein $R_6$ is defined as is $R_4$ or as is $R_5$ above, but need not be identical to either, so long as it can be described as is one or the other;

(d) from about 1 to about 20 percent by weight of an alkanolamine, such as mono-, di- or triethanolamine; and (e) from about 0 to about 65 percent by weight water.

10. The lubricant of claim 9 wherein said lubricant further consists essentially of a biocide in an amount not to exceed about 0.001 percent by weight.

11. The lubricant of claim 9 wherein said lubricant further consists essentially of a defoamer in an amount not to exceed about 0.01 percent by weight.

12. The concentrate of claim 1 wherein $R_4$ is triethanolamine, $R_5$ is the radical of an ethoxylated aliphatic alcohol and $R_6$ is hydrogen.

* * * * *